United States Patent [19]

Mikusch et al.

[11] Patent Number: 4,730,825

[45] Date of Patent: Mar. 15, 1988

[54] INSTALLATION FOR FEEDING SHEET METAL BLANKS TO A FIRST WORKING STAGE OF A MULTI-STAGE PRESS

[75] Inventors: Gerald Mikusch, Goeppingen; Heinz Schweitzer; Dieter Wolz, both of Heiningen, all of Fed. Rep. of Germany

[73] Assignee: L. Schuler GmbH, Goeppingen, Fed. Rep. of Germany

[21] Appl. No.: 868,544

[22] Filed: May 30, 1986

[30] Foreign Application Priority Data

May 30, 1985 [DE] Fed. Rep. of Germany ..... 3519334

[51] Int. Cl.[4] ..... B65H 5/10

[52] U.S. Cl. ..... 271/268

[58] Field of Search ..... 271/267, 268, 84, 85

[56] References Cited

U.S. PATENT DOCUMENTS 2,893,732 7/1959 Hauck ..... 271/268

3,309,077 3/1967 Myatt ..... 271/268 X 3,412,995 11/1968 Parups ..... 271/268

4,259,052 3/1981 Imanishi et al. .

4,501,523 2/1985 Haider ..... 271/268 X

*Primary Examiner*—Richard A. Schacher

*Attorney, Agent, or Firm*—Barnes & Thornburg

[57] ABSTRACT

An installation for feeding sheet-metal blanks to a first working stage of a multi-stage press, in which the blanks fed individually by way of a suspension conveyor into the area of an intermediate deposit station are to be transferred to active gripping devices attached at the transfer rails. For avoiding standstill periods of the transfer rails during the closing of the active gripping devices, the blank is lifted during the lifting of the transfer rail synchronously therewith. A carriage adapted to be lifted and lowered serves for that purpose which is synchronized by way of a crank drive at least in the lifting phase of the transfer rails with the lifting-lowering drive of the transfer rails.

6 Claims, 16 Drawing Figures

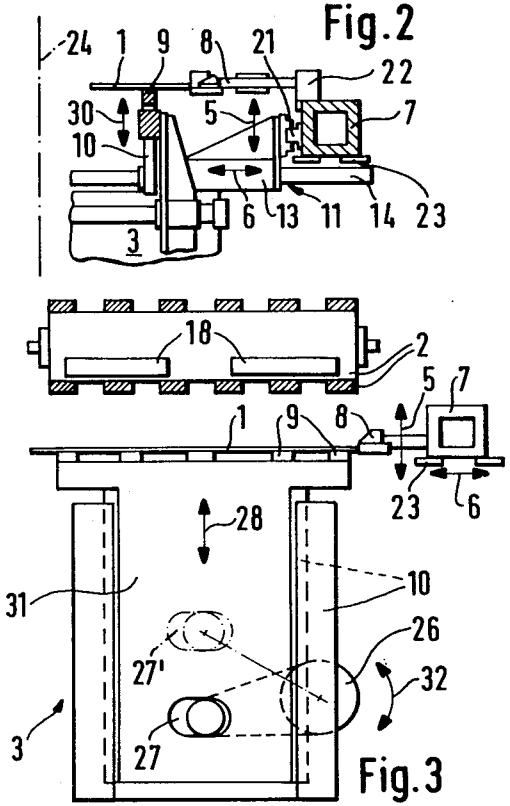
Fig.2
Fig.3
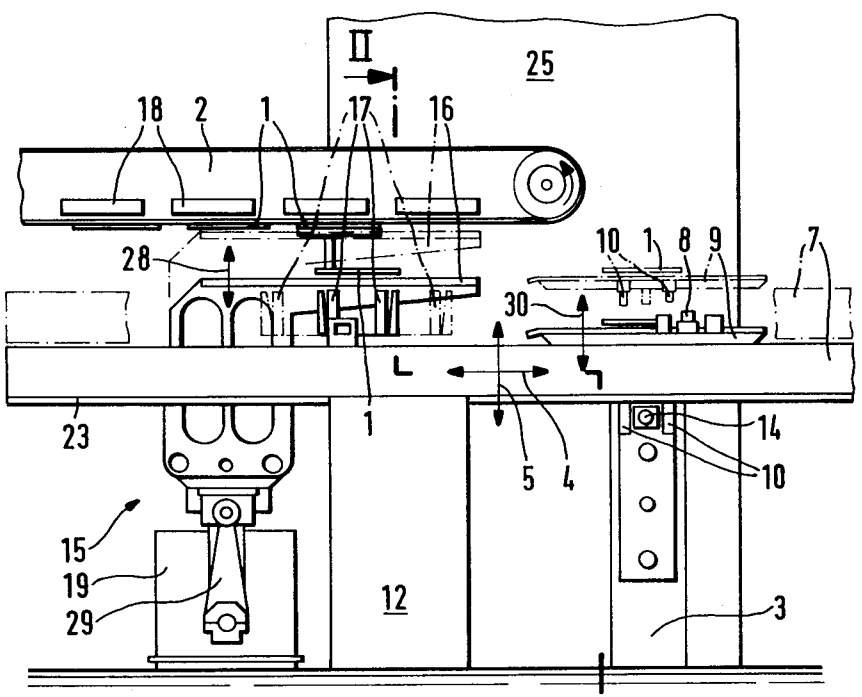
Fig.1

FIG. 4
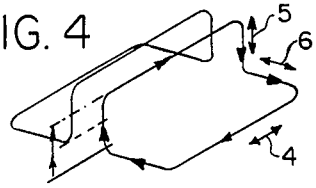
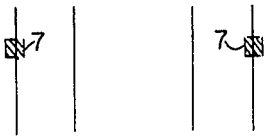
FIG. 5a
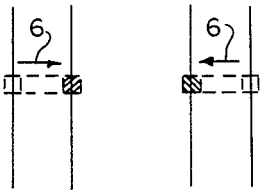
FIG. 5b
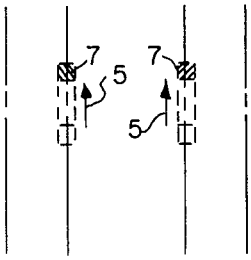
FIG. 5c
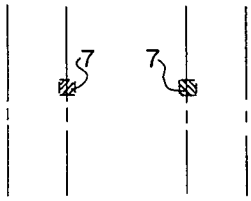
FIG. 5d
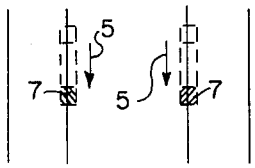
FIG. 5e
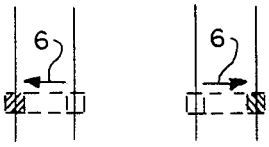
FIG. 5f
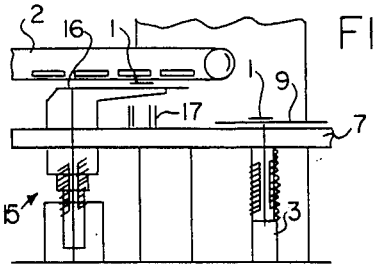
FIG. 6a
FIG. 6b
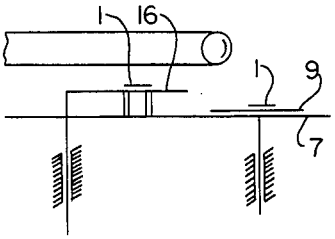
FIG. 7
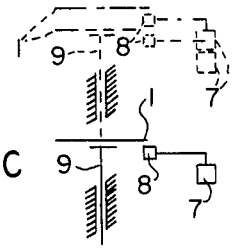
FIG. 6c
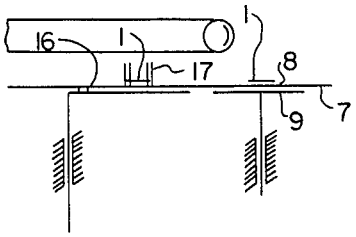
FIG. 6d
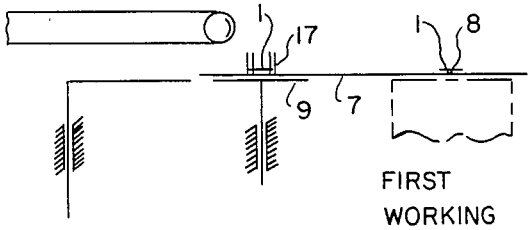
FIRST WORKING STAGE
FIG. 6e
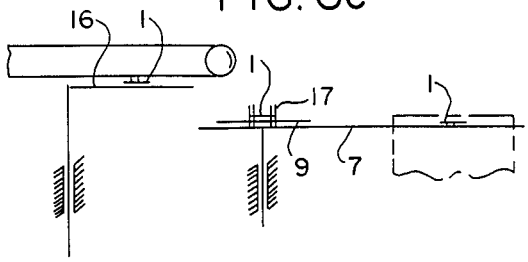

INSTALLATION FOR FEEDING SHEET METAL BLANKS TO A FIRST WORKING STAGE OF A MULTI-STAGE PRESS

BACKGROUND AND SUMMARY OF THE INVENTION

The present invention relates to an installation for feeding sheet metal blanks to a first working stage of a multi-stage press, with feeding means for the removal of sheet metal blanks from a supply stack and for the deposit in an intermediate deposit station, with transfer rails adapted to be driven in the transfer direction, in the lifting and lowering direction and in the closing and opening direction and with gripper tools attached thereat for gripping the blanks in the intermediate deposit station and for the transport of the blanks to the working stages.

Initially, individual sheet metal blanks are fed to the tools, respectively, tool sets in presses such as gang presses, multi-stage presses and large-part gang presses, which blanks are seized by active gripping devices, clamping gripping devices, for the transfer from an intermediate deposit station into the first working stage which, for the most part, is a deformation station. The active gripping devices are secured at transfer rails and are movable together with the same in the closing and opening direction, in the lifting and lowering direction and in the transfer direction. The movement in the closing and opening direction serves for the guidance of the active gripping devices to the blanks, respectively, correspondingly formed passive gripping devices to the workpieces, for the release, respectively, the deposit of the workpieces in the following working stage and for the guidance of the gripping devices out of the tools. Heretofore, it was necessary to seize larger sheet metal blanks deposited in the intermediate deposit station by active gripping devices during the standstill of the transfer rails after movement thereof in the closing direction. The time for gripping and for closing the active gripping devices reduces the output of the press.

A feed installation for sheet metal blanks to a first working stage of a stage press is described in the U.S. Pat. No. 4,259,052 which has the features described hereinabove. The blanks are removed from a supply stack by means of suction lifters of a vertical lifter, are taken over in the lifted-up position by suction cups of a horizontal conveyor and are deposited on deposit means of an intermediate deposit station. The feed takes place at the rhythm of the press and in synchronous movement with respect to the transfer rails. The blanks have to be seized during the standstill of the transfer rails so that waiting periods result which reduce the output of the press.

The object of the present invention resides in the provision of an installation of the aforementioned type, by means of which the blanks are seized during the lift movement of the transfer rails by active gripping devices attached thereat. For that purpose, the blanks are to be lifted during the vertical movement of the active gripping devices by means in the intermediate deposit station.

The underlying problems are solved according to the present invention in that the deposit means of the intermediate deposit station are supported liftable and lowerable in guide means, and in that movement-transmitting means are arranged between the deposit means and the transfer rail drive (enclosed drive mechanism)—with a direct pick-up of the movement in the lifting and lowering direction from the transfer rail drive, the movement transmitting means are then arranged between the deposit means and at least one transfer rail—for a movement of the deposit means synchronous in at least the lifting direction of the transfer rails.

In addition to a shortening of the cyclic operation of the transfer rails which leads to a higher output of the press, it is furthermore of advantage that the blanks are aligned already with the removal movement by the horizontal conveyor for the predetermined passage through the press.

These and other objects, features and advantages of the present invention will become more apparent from the following description when taken in connection with the accompanying drawing which shows, for purposes of illustration only, two embodiments in accordance with the present invention, and wherein:

BRIEF DESCRIPTION OF THE DRAWINGS

FIG. 1 is a schematic front elevational view of the transfer area of sheet metal blanks supplied by a suspension conveyor to the transfer rails in accordance with the present invention;

FIG. 2 is a somewhat schematic cross-sectional view through a first embodiment of an intermediate deposit station in accordance with the present invention, taken along line II—II of FIG. 1; and FIG. 3 is a schematic view, partly in cross section, of a second embodiment of an intermediate deposit station in accordance with the present invention.

FIG. 4 is a perspective view of the path of movement of the transfer rails shown in FIGS. 1–3 during a complete cycle.

FIGS. *5a–5f* are schematic end views of the pair of transfer rails 7 during one complete cycle.

FIGS. *6a–6e* are side schematic representations showing the relationship of the sheet metal blank 1, suspension conveyer 2, transfer rail 7, gripping devices 8, deposit means 9, support bracket 16 and centering stops 17, and correspond to FIGS. *5a–5e*, respectively, with respect to the cycle of operation. It should be noted that with respect to a side view, that FIG. *6a* corresponds to FIGS. *5f* and *5a*.

FIG. 7 is an end view of the relationship of the deposit means, the transfer rail 7 and the gripping device 8 with respect to the sheet metal blank 1 from a starting position in the solid lines to a gripping and gripped position, in the two sets of phantom lines.

DETAILED DESCRIPTION OF THE DRAWINGS

Referring now to the drawing wherein like reference numerals are used throughout the various views to designate like parts, and more particularly to FIG. 1, a suspension conveyor 2 transports individual sheet metal blanks 1 from a supply stack (not shown). The blanks 1 are retained at the bottom side of the suspension conveyor 2 by magnets 18 Within the area in which the blanks 1 are to be removed from the bottom side of the suspension conveyor 2, a transfer station generally designated by reference numeral 15 is arranged. The transfer station 15 includes a drive box 19 with a crank drive 29 for the lifting and lowering of a support bracket 16. The lifting and lowering movement of the support bracket 16 is schematically indicated by the double arrow 28. If the last magnets 18 of the suspension conveyor 2, as viewed in the movement direction of the blanks 1, can be controlled, i.e., are de-energizable, then the blank 1 can drop directly onto the support bracket 16 which is possibly extended up to the bottom side of the blank 1. During the lowering of the support bracket 16 as shown in FIGS. 6a, 6b and 6c, the blank 1 is seized and aligned by centering abutments 17. The centering abutments or stops 17, which are adjustable to different dimensions of the blanks 1, are moved along together with the transfer rails 7. The drive of the transfer rails 7 takes place in the transfer direction as shown in FIGS. 6c and 6d, double arrow 4, in the closing and opening direction as shown in FIGS. 5b and 5f, double arrow 6, and in the lifting and lowering direction as shown in FIGS. 5c and 5e, double arrow 5 at the operating cycle of the press, of which a press column or upright 25 is schematically indicated. The drive in the two displacement directions 5 and 6 takes place from an enclosed drive mechanism 12. The blank 1 as shown in FIGS. 5c and 6c is lifted off from the support bracket 16 together with the movement of the transfer rails 7 in the transfer direction 4 by means of the centering stops 17 and after a movement in the transfer direction is deposited on a deposit means 9 as shown in FIGS. 5d, 5e, 6d and 6e. The deposit means 9 is a part of an intermediate deposit station 3, as will be described more fully hereinafter by reference to FIG. 2. The movement of the suspension conveyor 2, the de-energization of the magnets 18 and the lifting and lowering movements of the support bracket 16 and of the deposit means 9 are matched to the movements of the transfer rails 7. The movement of the deposit means 9 in a vertical direction 30 is so matched that the blank is lifted on the deposit means 9 synchronously with the lifting movement 5 of the transfer rails 7. In addition to passive gripping devices (not shown), controllable gripping tools, active gripping device 8, are attached at the transfer rails 7 which, in the lifting movement 5, seize and hold fast the blank 1 at different support points. The closing of the active gripping devices 8 must be terminated or completed before the transfer rails 7 are moved in the transfer direction 4, i.e., still prior to reaching the highest position of the transfer rails 7 indicated in dash and dotted lines. The lifting and lowering movement of the deposit means 9 in the vertical direction 30 takes place by direct movement pick-up in the enclosed drive mechanism 12 or as is shown in FIG. 2.

The intermediate deposit 3 includes guides means 10, along which the deposit means 9 are displaceable in the vertical direction 30 which may consist, for example, of several deposit bars that are adjustable with respect to one another for changing the size of the deposit area. The adjustment in the vertical direction 30 takes place by way of a shaft 14, on which one support bracket 13 each coordinated to a respective transfer rail 7 each is displaceably supported. For that purpose, the shaft 14 extends over the entire movement range of the transfer rails 7. Each support bracket 13 is secured at a transfer rail 7 by way of a longitudinal bearing 21. The transfer rail 7 is displaceable in the transfer direction 4 within the longitudinal bearing 21 without taking along the bearing support bracket 13. With respect to height, in the lifting and lowering direction 5, the support bracket 13 follows the movements of the transfer rail 7 with entrainment of the deposit means 9 whereas in the opening and closing direction 6, without entrainment of the deposit means 9. Reference numeral 22 designates stop means for the active gripping devices 8. Guide means for the transfer rails 7 are indicated by reference numeral 23. The dash and dotted line 24 indicates the presence of two transfer rails 7 as well as the symmetry of the intermediate deposit station 3.

FIG. 3 illustrates an intermediate deposit generally designated by reference numeral 3 which takes over operationally the functions of the transfer station 15 and of the intermediate deposit station 3. The deposit means 9 is secured adjustable to the size of the blanks 1 on a carriage 31 adapted to be lifted and lowered in guide means 10. The deposit surface of the deposit means 9 is liftable, for example, by way of a crank drive 26, 27 up to near the bottom side of the suspension conveyor 2 for the transfer of the fed blank 1. The blank 1 is lowered up to the position in which the transfer rails 7 are moved in the closing and opening direction 6. The blank 1 is lifted by way of the deposit means 9 synchronously with the movement of the active gripping devices 8 until the active gripping devices 8 have seized the blank 1 and hold the same fast. This movement is synchronized with the movement of the transfer rails 7 beginning with the transmission present in the enclosed drive mechanism (FIG. 1). In an additional movement to be carried out by the crank 26, the deposit means 9 is to be lifted again for the acceptance of a next blank 1. The double arrow 28 points to the lifting and lowering movement of the carriage 31 whereas the double arrow 32 points to the pivot, respectively, crank movement of the crank 26.

While we have shown and described only two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An installation for feeding blanks to a first working stage of a multi-stage press, comprising feed means for depositing blanks in an intermediate deposit station, transfer rail means operable to be driven in a transfer direction, in a lifting and lowering direction and in a closing and opening direction by transfer rail drive means, gripping means mounted on said transfer rail means for seizing the blanks in the intermediate deposit station and for transporting the blanks through the working stages, the intermediate deposit station including deposit means liftably and lowerably supported in guide means, and movement transmission means connected between the deposit means and the transfer rail drive means for producing seizing of said blanks by said gripping means simultaneously with producing synchronous lifting movement of the deposit means and transfer rail means.

2. An installation according to claim 1, wherein said movement transmission means is arranged between said transfer rail drive means and the deposit means.

3. An installation according to claim 1, wherein with a direct pick-up of the movement in the lifting and lowering direction from the transfer rail means, the movement transmission means is arranged between the deposit means and at least one transfer rail means.

4. An installation for feeding blanks to a first working stage of a multi-stage press, comprising feed means for depositing blanks in an intermediate deposit station, transfer rail means operable to be driven in a transfer direction, in a lifting and lowering direction and in a closing and opening direction by transfer rail drive means, gripping means mounted on said transfer rail means for seizing the blanks in the intermediate deposit station and for transporting the blanks through the working stages, the intermediate deposit station including deposit means liftably and lowerably supported in guide means, and movement transmission means operatively connected between the deposit means and the transfer rail means for a movement of the deposit means synchronous with the movement in at least the lifting direction of the transfer rail means; and wherein one support bracket means is attached at each transfer rail means within the area of the intermediate deposit station by way of a substantially horizontal guide means, shaft means extending transversely to the longitudinal direction of the transfer rail means and guided in said support bracket means, the shaft means having a length substantially covering the opening and closing movement range of the transfer rail means, and the deposit means including a pair of deposit bars being adjustably secured at said shaft and means for adjusting the mutual spacing of said deposit bar.

5. An installation according to claim 4, wherein ahead of the intermediate deposit station, as viewed in the transfer direction, a suspension conveyor means for the individual transport of blanks and a transfer station for the acceptance of the blanks from the suspension conveyor means are provided, the transfer station including a vertically reciprocable deposit means for the blanks fed by the suspension conveyor means, and the transfer rail means having centering stop means adjustable mutually with respect to spacing which correspond with the deposit means of the transfer station seizing the blank and with the deposit means of the intermediate deposit station depositing the blanks.

6. An installation for feeding blanks to a first working stage of a multi-stage press, comprising feed means for depositing blanks in an intermediate deposit station, transfer rail means operable to be driven in a transfer direction, in a lifting and lowering direction and in a closing and opening direction by transfer rail drive means, gripping means mounted on said transfer rail means for seizing the blanks in the intermediate deposit station and for transporting the blanks through the working stages, the intermediate deposit station including deposit means liftably and lowerably supported in guide means, and movement transmission means operatively connected between the deposit means and the transfer rail means for a movement of the deposit means synchronous with the movement in at least the lifting direction of the transfer rail means; and wherein ahead of the intermediate deposit station, as viewed in the transfer direction, a suspension conveyor means for the individual transport of blanks and a transfer station for the acceptance of blanks from the suspension conveyer means are provided, the transfer station including a vertically reciprocable deposit means for the blanks fed by the suspension conveyer means, and the transfer rail means having centering stop means adjustable mutually with respect to spacing which correspond with the deposit means of the transfer station seizing the blank and with the deposit means of the intermediate deposit station depositing the blanks.

* * * * *